US011287780B2

(12) United States Patent
Yamamoto et al.

(10) Patent No.: US 11,287,780 B2
(45) Date of Patent: Mar. 29, 2022

(54) ELECTRONIC TIMEPIECE

(71) Applicant: Seiko Epson Corporation, Tokyo (JP)

(72) Inventors: Hironobu Yamamoto, Shiojiri (JP); Tadashi Aizawa, Matsumoto (JP)

(73) Assignee: Seiko Epson Corporation

( * ) Notice: Subject to any disclaimer, the term of this patent is extended or adjusted under 35 U.S.C. 154(b) by 477 days.

(21) Appl. No.: 16/355,939

(22) Filed: Mar. 18, 2019

(65) Prior Publication Data

US 2019/0286069 A1 Sep. 19, 2019

(30) Foreign Application Priority Data

Mar. 19, 2018 (JP) ..... JP2018-050959

(51) Int. Cl.

| | |
|---|---|
| ***G04R 60/10*** | (2013.01) |
| ***G04R 20/04*** | (2013.01) |
| ***G04G 17/06*** | (2006.01) |
| ***G04G 21/04*** | (2013.01) |
| ***G04C 10/02*** | (2006.01) |

(52) U.S. Cl.

CPC ..... *G04R 60/10* (2013.01); *G04C 10/02* (2013.01); *G04G 17/06* (2013.01); *G04G 21/04* (2013.01); *G04R 20/04* (2013.01)

(58) Field of Classification Search

CPC ..... G04R 60/10; G04R 20/04; G04R 20/02; G04C 10/02; G04G 17/06; G04G 21/04; G04G 19/00; G04G 17/08; G04G 17/04

USPC ..... 368/47

See application file for complete search history.

(56) References Cited

U.S. PATENT DOCUMENTS

| | | | | |
|---|---|---|---|---|
| 8,467,272 | B2 * | 6/2013 | Fujisawa | G04C 10/02 368/47 |
| 2011/0158052 | A1 | 6/2011 | Suzuki | |
| 2012/0105288 | A1 | 5/2012 | Abe | |
| 2012/0170423 | A1 | 7/2012 | Fujisawa | |
| 2016/0103428 | A1 * | 4/2016 | Fujisawa | G04R 60/10 368/28 |

(Continued)

FOREIGN PATENT DOCUMENTS

| | | |
|---|---|---|
| CN | 102109807 A | 6/2011 |
| CN | 102591192 A | 7/2012 |

(Continued)

*Primary Examiner* — Edwin A. Leon

(74) *Attorney, Agent, or Firm* — Harness, Dickey & Pierce, P.L.C.

(57) ABSTRACT

An inverted-F antenna is included in an electronic timepiece without increasing the thickness of the electronic timepiece. In an electronic timepiece having a dial, a plastic calendar plate disposed on the back cover side of the dial, and a main plate disposed on the back cover side of the calendar plate, a first conductor element, second conductor element, and a shorting element shorting the first conductor element and second conductor element are formed in unison with the calendar plate, enabling the calendar plate to function as an inverted-F antenna. The first conductor element is disposed on the dial side surface of the calendar plate, and superimposed with the dial in a plan view. The second conductor element is disposed on the main plate side of the calendar plate, and superimposed in the plan view with the first conductor element. The shorting element is disposed to the side of the calendar plate.

20 Claims, 14 Drawing Sheets

(56) References Cited

U.S. PATENT DOCUMENTS

| | | | | |
|---|---|---|---|---|
| 2016/0103429 | A1* | 4/2016 | Fujisawa ..... | G04G 21/04<br>368/37 |
| 2017/0221636 | A1 | 8/2017 | Aizawa et al. | |
| 2018/0239308 | A1 | 8/2018 | Yamamoto et al. | |

FOREIGN PATENT DOCUMENTS

| | | | |
|---|---|---|---|
| JP | 2012-093211 | A | 5/2012 |
| JP | 2012-093288 | A | 5/2012 |
| JP | 2017-135640 | A | 8/2017 |
| JP | 2018-136296 | A | 8/2018 |

* cited by examiner

CURRENT FLOWING BETWEEN
SCREW HOLES AND TO BOTH EDGES

LESS CURRENT FLOW
BETWEEN SCREW HOLES

LESS CURRENT FLOW FROM
SCREW HOLES TO OUTSIDE EDGES

ELECTRONIC TIMEPIECE

BACKGROUND

1. Technical Field

The present invention relates to an electronic timepiece having an antenna.

2. Related Art

When a GPS (Global Positioning System) receiver is incorporated in an electronic timepiece such as a wristwatch, the size of the antenna used by the receiver must be made as small as possible. JP-A-2012-93211, for example, describes an electronic timepiece having a patch antenna capable of receiving GPS signals transmitted from GPS satellites (navigation satellites) disposed between the dial and main plate.

A problem with the technology described in JP-A-2012-93211 is that the thickness of the electronic timepiece is increased by the space required to provide the patch antenna.

SUMMARY

To address the foregoing problem, an electronic timepiece according to the invention has a dial; and a calendar plate holding a calendar wheel disposed on a back side of the dial, a first surface, which is the surface on the dial side, disposed on the back side of the dial, and having disposed thereto a first conductor element of an antenna, and a second surface, which is the surface on the opposite side as the first surface, and has disposed thereto a second conductor element of the antenna at a position superimposed with the first conductor element in a plan view from a direction perpendicular to the dial.

This aspect of the invention forms an antenna using a first conductor element disposed on a first side of a plastic calendar plate, and a second conductor element disposed on the second side of the calendar plate. An antenna can therefore be incorporated into the electronic timepiece without increasing the thickness of the electronic timepiece compared with configurations in which the antenna is separate from the calendar plate.

In another aspect of the invention, the calendar plate has a side surface located between the first surface and the second surface, and a shorting element that electrically connects the first conductor element and second conductor element is disposed to the side surface.

This aspect of the invention enables forming an inverted-F antenna from a first conductor element, second conductor element, and shorting element, and can adjust the reception frequency of the inverted-F antenna by reducing the size of the shorting element with a laser, for example. This configuration enables reducing the parts count and forming an inverted-F antenna with a reception frequency that is more easily adjustable than in a configuration in which the first conductor element and second conductor element are formed from sheet metal and are shorted by a conductive pin, for example.

An electronic timepiece according to another aspect of the invention also has a main plate disposed on the second surface side of the calendar plate; and a first fastener disposed non-conductively to the first conductor element and second conductor element, and fastening the calendar plate to the main plate.

This configuration can reliably fasten the calendar plate to the main plate. If there is conductivity between the first conductor element and second conductor element through the first fastener, the reception frequency of the antenna formed by the first conductor element and second conductor element may be affected. This configuration enables reliably fastening the calendar plate to the main plate while avoiding interference with the reception frequency of the antenna formed by the first conductor element and second conductor element.

An electronic timepiece according to another aspect of the invention also has a solar panel disposed between the dial and the calendar plate in a side view.

In this aspect of the invention of an electronic timepiece, the first conductor element may be connected to whichever of a positive terminal and a negative terminal of the solar panel ground potential is applied.

In this configuration, of the positive terminal and negative terminal of the solar panel, it is only necessary to dispose outside of the antenna formed by the first conductor element and second conductor element only the terminal to which a potential different from the ground potential is applied, and the space required outside of the antenna can be reduced compared with a configuration in which both the positive terminal and negative terminal are located outside the antenna. As a result, the effect of the solar panel can be cancelled while reducing the size of the electronic timepiece.

An electronic timepiece according to another aspect of the invention also has a conductive case housing the calendar plate, and the inside diameter of the case is greater than the outside diameter of the calendar plate in a plan view.

This configuration prevents current flowing to the case in the opposite direction as the current flowing to the antenna formed by the first conductor element and second conductor element from reducing the sensitivity of the antenna.

An electronic timepiece according to another aspect of the invention has a dial; a calendar plate holding a calendar wheel disposed on a back side of the dial, a first surface, which is the surface on the dial side, disposed on the back side of the dial, and having disposed thereto a first conductor element of an antenna, and a second surface, which is the surface on the opposite side as the first surface, and has disposed thereto a second conductor element of the antenna at a position superimposed with the first conductor element in a plan view from a direction perpendicular to the dial; a main plate disposed on the second surface side of the calendar plate; and a conductor plate disposed between the calendar plate and the main plate, and electrically connected as an element of the antenna to the second conductor element.

This aspect of the invention enables forming an antenna using a conductor plate the electrically connects a first conductor element disposed on a first side of a plastic calendar plate, and a second conductor element disposed on the second side of the calendar plate. An antenna can therefore be incorporated into the electronic timepiece without increasing the thickness of the electronic timepiece compared with configurations in which the antenna is separate from the calendar plate.

In an electronic timepiece according to another aspect of the invention, the calendar plate has a side surface located between the first surface and the second surface, and a shorting element disposed to the side surface and electrically connecting the first conductor element and second conductor element.

This aspect of the invention enables forming an inverted-F antenna from a first conductor element, second conductor element, and shorting element, and can adjust the reception frequency of the inverted-F antenna by using a laser, for example, to reduce the size of the shorting element formed on the side of the calendar plate. This configuration enables reducing the parts count and forming an inverted-F antenna with a reception frequency that is more easily adjustable than in a configuration in which the first conductor element and second conductor element are formed from sheet metal and are shorted by a conductive pin, for example.

In an electronic timepiece according to another aspect of the invention, the conductor plate is a magnetic shield.

This configuration uses the magnetic shield to function as the bottom antenna plane of the antenna.

In an electronic timepiece according to another aspect of the invention, the conductor plate is configured as a pure iron plate with a nickel coating, and the thickness of the nickel coating is greater than or equal to 2 micrometers and less than or equal to 10 micrometers.

This configuration can suppress a drop in antenna sensitivity caused by the skin effect resulting from the high electrical resistance of pure iron.

In an electronic timepiece according to another aspect of the invention, the area obtained by subtracting the area of the part where the second conductor element is superimposed with the conductor plate from the sum of the area of the second conductor element and the area of the conductor plate is greater than the area of the first conductor element in a plan view.

This configuration can suppress a drop in antenna sensitivity caused by the size of the bottom antenna plane being small.

An electronic timepiece according to another aspect of the invention also has a second fastener disposed to a position superimposed in a plan view with the second conductor element and the conductor plate, and fastening the second conductor element in contact with the conductor plate.

This configuration can fasten the second conductor element and the conductor plate while assuring a reliable electrical connection.

In an electronic timepiece according to another aspect of the invention, in a plan view, the outside diameter of the first conductor element is greater than the inside diameter of the calendar wheel.

This aspect of the invention can increase the area of the first conductor element disposed on the first side of the calendar plate, and improve the sensitivity of an antenna in which the first conductor element is the top antenna plane.

In an electronic timepiece according to another aspect of the invention, the calendar plate covers the calendar wheel, and has an opening through which part of the calendar wheel is visible.

This configuration enables seeing part of the calendar wheel through the opening. As a result, the size of the calendar plate can be increased while avoiding impairing the visibility of the calendar wheel, and can increase the size of the first conductor element disposed on the first side of the calendar plate. In other words, this aspect of the invention can improve the sensitivity of an antenna in which the first conductor element is the top antenna plane while avoiding impairing the visibility of the calendar wheel.

Other objects and attainments together with a fuller understanding of the invention will become apparent and appreciated by referring to the following description and claims taken in conjunction with the accompanying drawings.

DETAILED DESCRIPTION

Preferred embodiments of the invention are described below with reference to the accompanying figures. Note that the scale and size of members and parts shown in the figures referenced below may differ from the actual scale and size for convenience of description and illustration. The following embodiments include various technically desirable features while describing preferred embodiments of the invention, but the scope of the invention is not limited to the following.

Embodiment 1

Figure 1:
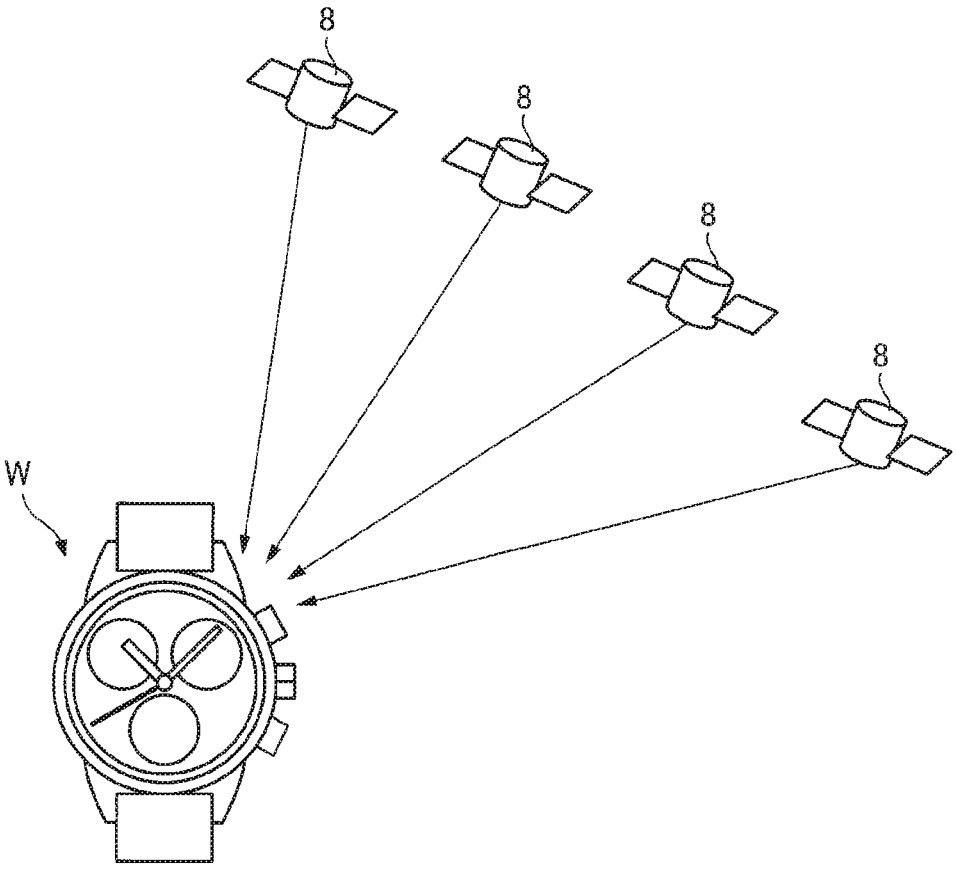
FIG. 1 is an overview of a GPS including an electronic timepiece according to the invention.
Figure 2:
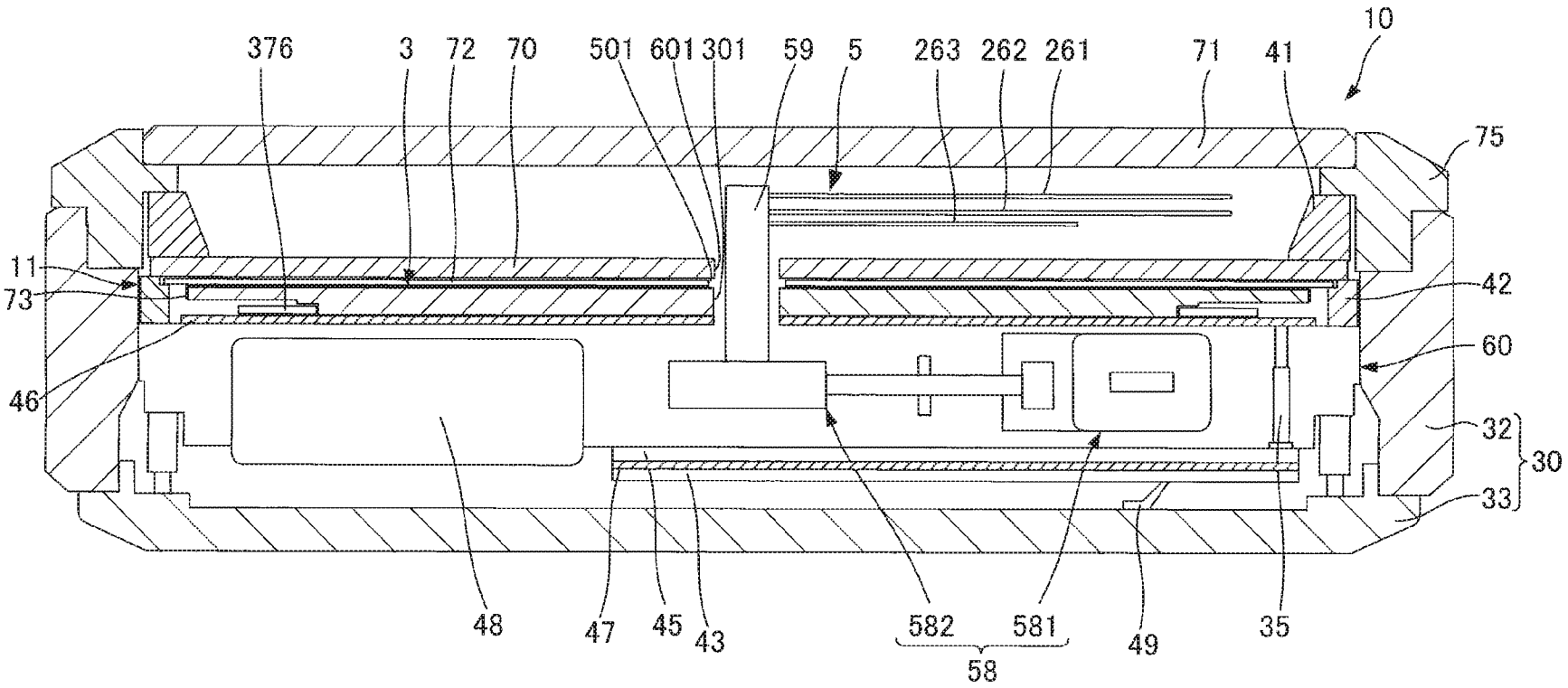
FIG. 2 is a section view of the electronic timepiece.
Figure 3A:
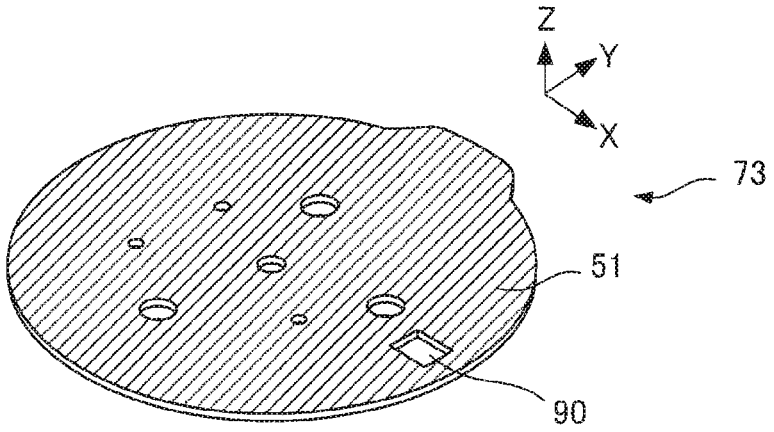
FIG. 3A is an oblique view from the face side of the calendar plate of the electronic timepiece.
Figure 3B:
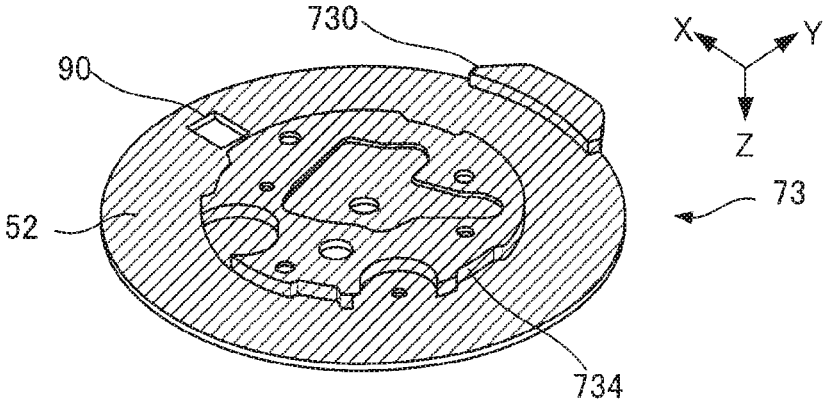
FIG. 3B is an oblique view of the calendar plate from the back side.
Figure 3C:
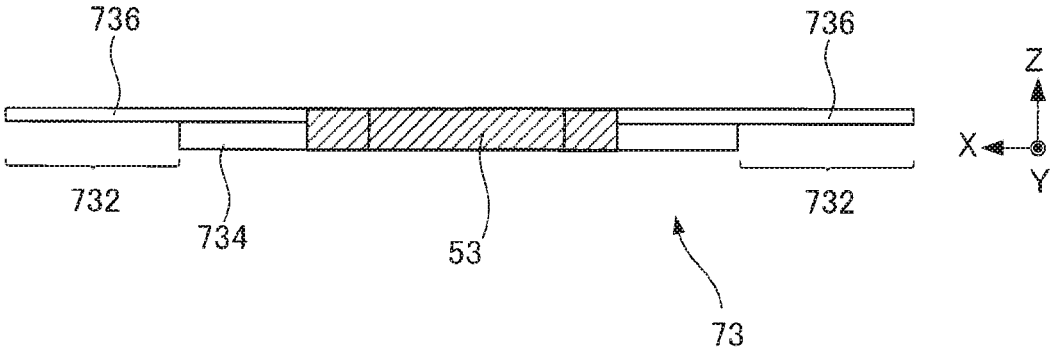
FIG. 3C is a side view of the calendar plate.

A first embodiment of the invention is described below with reference to FIG. 1, FIG. 2, FIG. 3A, FIG. 3B, and FIG. 3C. FIG. 1 is an overview of a GPS system including an electronic timepiece W according to an embodiment of the invention. FIG. 2 is a section view showing the internal configuration of the electronic timepiece W. FIG. 3A is an oblique view from the face side of a calendar plate 73 used in the electronic timepiece W. FIG. 3B is an oblique view from the back side of the calendar plate 73. Note that the back side as used herein refers to the side of the electronic timepiece W worn against the wrist of the user, and the face side is the opposite side as the back side. FIG. 3C is a side view of the calendar plate 73 as seen from the Y-axis in FIG. 3A.

The electronic timepiece W receives radio waves (referred to below as satellite signals) transmitted from GPS satellites 8 (see FIG. 1). The electronic timepiece W includes at least the ability to set the internal time based on satellite signals received from the GPS satellites 8, and the ability to process a navigation calculation (acquire positioning information) using GPS time information and satellite orbit information. The electronic timepiece W has a back cover on the side worn against the wrist of the user. In the description below, the view from the face (front) side in the direction to where the back cover is disposed is referred to as the plan view.

As shown in FIG. 1, GPS satellites 8 are an example of positioning information satellites (navigation satellites) orbiting the Earth on known orbits in space. The GPS satellites 8 transmit a high frequency signal, such as a 1.57542 GHz carrier signal (L1 signal), with a superimposed navigation message. Herein, the 1.57542 GHz signal on which the navigation message is superimposed is referred to as a satellite signal. The satellite signals are right-hand circularly polarized (RHCP) waves.

At present, there are approximately 30 GPS satellites 8 in orbit (only four shown in FIG. 1). To enable identifying which GPS satellite 8 transmitted a specific satellite signal, each GPS satellite 8 superimposes a unique 1023 chip (1 ms period) pattern called a C/A code (Coarse/Acquisition Code) on the satellite signals transmitted by that satellite. Each chip in the C/A code is a value of either +1 or −1 in a pseudo-random pattern. The C/A code superimposed on a particular satellite signal can therefore be detected by determining the correlation between the satellite signal and the pattern of each C/A code.

Each GPS satellite 8 carries an atomic clock. Each satellite signal carries extremely precise GPS time information that is kept by the atomic clock. The slight difference in the time kept by the atomic clock on each GPS satellite 8 is measured on Earth by a control segment. The satellite signals contain a time correction parameter for correcting this time difference. The electronic timepiece W receives the satellite signal transmitted from a single GPS satellite 8, and acquires time information using the GPS time information and the time correction parameter carried in the received satellite signal.

The operating mode in which this time information can be acquired is referred to as the timekeeping mode, and can correct the internal time (minute and second) of the electronic timepiece W using the acquired time information.

Orbit information indicating the location of the GPS satellite 8 on its orbit is also included in the satellite signal. The electronic timepiece W can therefore also calculate its location (positioning information) using the GPS time information and orbit information. The positioning information calculation supposes that there is some degree of error in the internal time kept by the electronic timepiece W. More specifically, in addition to the x, y, z parameters required to identify the location of the electronic timepiece W in three-dimensional space, the time error of the electronic timepiece W is also unknown. The electronic timepiece W therefore receives satellite signals transmitted from three or more GPS satellites 8, calculates the location based on the GPS time information and orbit information contained in the satellite signals, and thereby acquires positioning information identifying the current location.

The operating mode for acquiring this positioning information is referred to as the navigation mode, and in this mode the time difference can be corrected based on the acquired positioning information, and the current time can be automatically displayed. Because power consumption is greater during reception in the navigation mode than during reception in the positioning mode, the internal time correction operation (manual reception or automatic reception) in an environment where correcting the time difference is not necessary is preferably executed in the timekeeping mode.

The electronic timepiece W is worn by the user at a specific location, such as the left wrist, and displays information including the current time, date, operating mode, and daylight saving time information.

Note that in addition to information related to the current time, date, operating mode, and daylight saving time, the electronic timepiece W may also display the location information acquired in the positioning mode or time zone information based on the location information, or information about user movements (physical quantity information). Further alternatively, information detected by sensors such as a heart rate sensor may also be displayed.

The electronic timepiece W has a body 10, and a band for holding the body 10 on the user. The band is not shown in FIG. 2. As shown in FIG. 2, the body 10 includes an external case 30. The external case 30 includes a cylindrical case member 32, a back cover 33 disposed to the side worn in contact with the user, and a bezel 75 disposed to the case member 32 on the opposite side as the back cover 33.

A glass crystal 71 that protects the movement 11 is disposed inside the bezel 75. The back cover 33, case member 32, and bezel 75 may be made from stainless steel or other metal, or from plastic, but is preferably made from an electrically conductive material such as metal. The back cover 33, case member 32, and bezel 75 of the electronic timepiece W in this embodiment are metal. By making the back cover 33, case member 32, and bezel 75 from an electrically conductive material, electrical disturbance from external sources that may affect the operating precision of components inside the external case 30 can be shielded. A more high quality, fashionable appearance can also be achieved. In this embodiment, the case member 32 and back cover 33 are fastened together by a screw configuration (threaded engagement). Note that the invention is not limited to a configuration enabling separating the case member 32 and back cover 33, and a monolithic construction may be used.

The body 10 contains a display 5 (see FIG. 2) including a dial 70 and hands (including an hour hand 263, minute hand 262, second hand 261 in this example) disposed below the crystal 71 so that the information displayed on the display 5 can be seen by the user through the crystal 71. The time and other information can be displayed on the display 5.

Between the dial 70 and crystal 71 is a dial ring 41. While not shown in FIG. 2, on the side of the body 10 are a crown and multiple buttons serving as operators for changing the display mode of the display 5, or starting and stopping the movement of the hands, for example.

Note that this embodiment describes using a glass crystal 71 on the top face of the body 10, but the face member may be made from a material other than glass, such as a transparent plastic, as long as the material has sufficient transparency for the user to see the display 5, and strength sufficient to protect the display 5 and other configurations housed inside the external case 30. In addition, a configuration having a bezel 75 is described above, but a configuration not having a bezel 75 is also conceivable.

As shown in FIG. 2, the body 10 also houses a movement 11. While not shown in detail in FIG. 2, the movement 11 is disposed on the back side of the dial 70, that is, inside the space between the dial 70, case member 32, and back cover 33. As also shown in FIG. 2, the movement 11 includes a solar panel 72, calendar plate 73, date indicator 376, first magnetic shield 46, main plate 60, circuit board 45, a storage battery 48 that functions as a power source charged by the solar panel 72, a second magnetic shield 47, a conductive spring 49, and a circuit board holder 43 electrically connected to the back cover 33 through the conductive spring 49. The solar panel 72 is disposed on the back cover side of the dial 70, and the calendar plate 73 is disposed on the back cover side of the solar panel 72. In other words, the solar panel 72 is disposed between the dial 70 and the calendar plate 73. The dial 70 and solar panel 72 are supported by a dial support ring 42. The dial support ring 42 is fastened to the main plate 60.

The movement 11 also has a stepper motor 581 as a drive element 58 for driving the hands of the display 5, and a wheel train 582 that transfers rotation of the stepper motor 581 to the pivots 59 that functions as rotating shafts. In this electronic timepiece W, rotation of the stepper motor 581 as the drive source is decelerated by the wheel train 582 and transferred to the pivots 59, and by the pivots 59 turning, the hands can be driven rotationally. Note that the stepper motor 581, wheel train 582, and pivots 59 are attached to the main plate 60.

Through-holes 301, 501, 601, through which the pivots 59 pass, are formed in the dial 70, solar panel 72, and calendar plate 73.

The configuration of the calendar plate 73 with reference to FIG. 3A, FIG. 3B, and FIG. 3C will be described. FIG. 3A is an oblique view of the calendar plate 73 from the face side, and FIG. 3B is an oblique view of the calendar plate 73 from the back cover side. FIG. 3C is a side view of the calendar plate 73 from the direction of the Y-axis in FIG. 3A.

The calendar plate 73 is a member that holds a calendar mechanism including a calendar wheel (in this embodiment, a date indicator 376), and a wheel (not shown in the figure) for driving the calendar wheel. The calendar mechanism may be configured to include a day wheel for displaying the day of the week in addition to the date indicator 376.

As shown in FIG. 3A and FIG. 3B, the calendar plate 73 is a substantially disk-shaped member made of plastic, and is formed to cover the date indicator 376. The calendar plate 73 also has a protruding part 730 extending from part of the outside circumference. The range of a specific length in the radial direction from the outside circumference of the calendar plate 73 is an escape 736 that is thinner than the thickness of the middle area 734, forming a date indicator holder 732 when the calendar plate 73 is assembled in the movement 11.

As also shown in FIG. 3A and FIG. 3B, an opening 90 through which part of the date indicator 376 held by the calendar plate 73 can be seen is formed in the calendar plate 73, and a date window (not shown in the figure) is formed in the dial 70 at the location corresponding to the opening 90. By providing this opening 90, reading the calendar through the window is not affected even if the date indicator 376 is covered by the calendar plate 73.

In an electronic timepiece W according to the invention, the calendar plate 73 also functions as a PIFA (Plate Inverted F Antenna, or Planar Inverted F Antenna, referred to below as an inverted-F antenna) that receives high frequency signals carrying GPS time information and location information from GPS satellites 8. While not shown in FIG. 2, FIG. 3A, FIG. 3B, and FIG. 3C, the inverted-F antenna 3 connects to ground through conductive pins, for example.

As shown in FIG. 3A, FIG. 3B, and FIG. 3C, the calendar plate 73 is made from a resin with a low dissipation factor (for example, $1\times10^{-4}$) and is formed as a disk with substantially the same radius as the dial 70. The calendar plate 73 is made from a resin with a low dissipation factor to minimize the drop in antenna sensitivity. On the surface (the surface on the dial side, referred to as the first surface) of the calendar plate 73, an electrically conductive first conductor 51 that serves as the top antenna plane (radiating electrode) of the inverted-F antenna 3 is disposed superimposed with the dial 70 in a plan view from the direction perpendicular to the dial 70. In this embodiment of the invention, the outside diameter of the first conductor 51 is greater than the inside diameter of the date indicator 376, and an opening is formed in the calendar plate 73 at a position corresponding to opening 90 in the first conductor 51. This is to assure the visibility of the calendar through the date window.

A feed pin 35 (feed) electrically connecting the first conductor 51 and circuit board 45 is also provided (see FIG. 2). On the back side of the calendar plate 73 (the second surface on the opposite side as the first surface), an electrically conductive second conductor 52 that functions as the bottom antenna plane (ground electrode) of the inverted-F antenna 3 is disposed superimposed with the first conductor 51 in the plan view described above.

In this embodiment of the invention, the outside diameter of the second conductor 52 is also greater than the inside diameter of the date indicator 376, and an opening is formed in the calendar plate 73 at a position corresponding to opening 90 in the second conductor 52. This is to assure the visibility of the calender through the date window.

An electrically conductive shorting element 53 that electrically connects (that is, shorts) the first conductor 51 and second conductor 52 is disposed on the Y-axis side of the protruding part 730 of the calendar plate 73. The first conductor 51, second conductor 52, and shorting element 53 are formed in unison with the calendar plate 73 by plating or vapor deposition. In FIG. 3A, FIG. 3B, and FIG. 3C, the first conductor 51, second conductor 52, and shorting element 53 are shaded.

When the inverted-F antenna 3 is made from sheet metal, a shorting element such as a spring is used to short the top antenna plane and the bottom antenna plane, complicating the antenna configuration with additional parts and fastening the spring. This embodiment of the invention solves this problem and simplifies making an inverted-F antenna 3 by forming the top antenna plane, the bottom antenna plane, and the shorting element 53 on the top, bottom, and side of a plastic, substantially disk-shaped calendar plate 73. The reception frequency of the inverted-F antenna 3 according to this embodiment can also be easily adjusted by cutting the shorting element 53 with a laser, for example. For example, if the width of the shorting element 53 is reduced or multiple shorting elements 53 are provided, the reception frequency can be adjusted by appropriately removing part of the multiple shorting elements 53. As a result, there is no need to provide a different inverted-F antenna 3 for each model of the electronic timepiece, and the reception frequency can be adjusted by simply adjusting the area of the shorting element 53.

Furthermore, because the calendar plate 73 also serves as the inverted-F antenna 3 in this embodiment, an inverted-F antenna 3 can be incorporated into the electronic timepiece without increasing the parts count.

In addition, this embodiment enables incorporating an inverted-F antenna 3 in the electronic timepiece W while avoiding increasing the thickness of the electronic timepiece W when compared with a configuration in which the inverted-F antenna 3 and calendar plate 73 are separate components.

This configuration also enables making the outside diameter of the top antenna plane and the bottom antenna plate of the inverted-F antenna 3 larger than the inside diameter of the date indicator 376, and improving antenna sensitivity while avoiding affecting the visibility of the calendar through the date window.

Embodiment 2

Figure 4A:
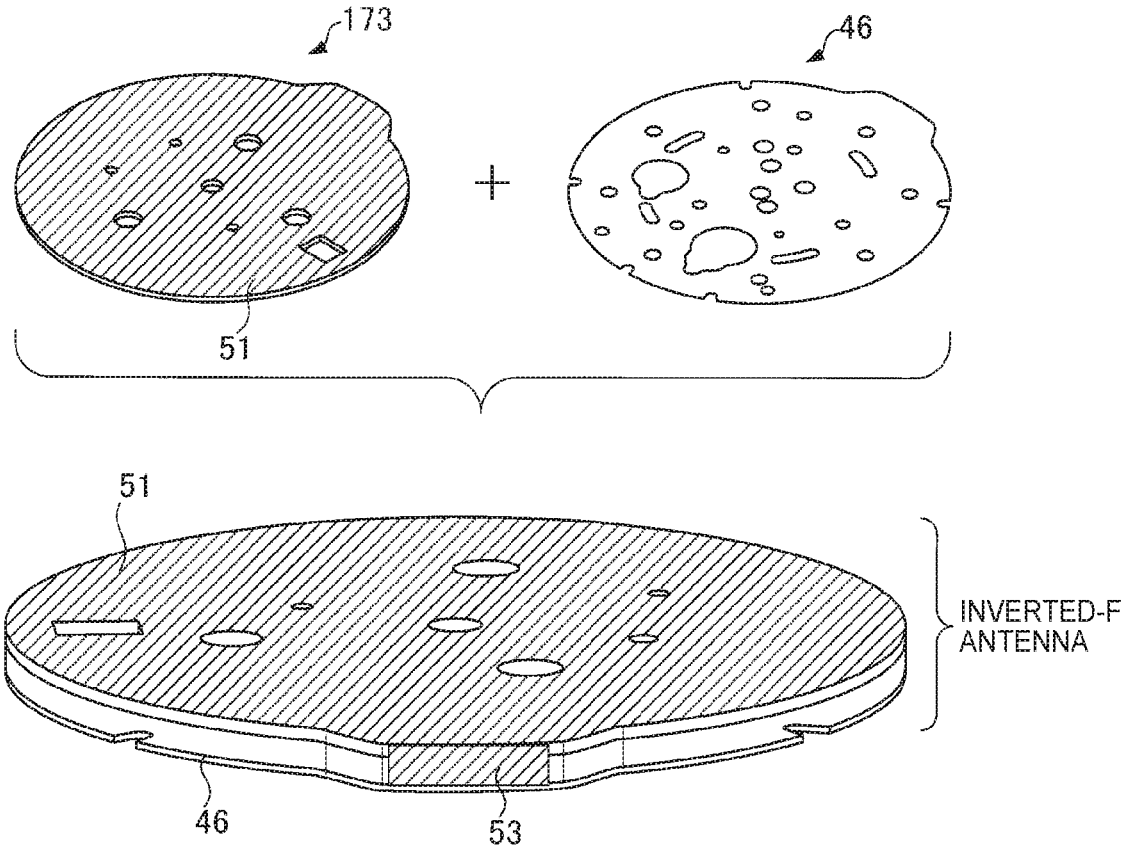
FIG. 4A is a perspective view of the configuration of an inverted-F antenna according to a second embodiment of the invention.
Figure 4B:
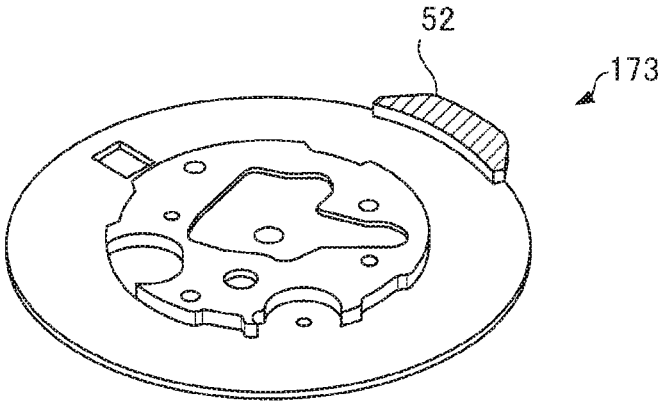
FIG. 4B is an oblique view from the back side of the calendar plate forming the inverted-F antenna and magnetic shield.

An electronic timepiece according to the second embodiment of the invention is described next with reference to FIG. 4A, FIG. 4B, and FIG. 5. Note that further description of configurations that are the same in this and the first embodiment is omitted below.

In the first embodiment described above, the calendar plate 73 also functions as an inverted-F antenna. As shown in FIG. 4A, however, this embodiment of the invention differs from the first embodiment in configuring the inverted-F antenna with the calendar plate 173 and a first magnetic shield 46 disposed between the calendar plate 73 and the main plate 60 disposed on the second surface side of the calendar plate 73.

Like the calendar plate 73, the calendar plate 173 is also made from a resin with a low dissipation factor (for example, $1\times10^{-4}$), and like the calendar plate 73, the first conductor 51, second conductor 52, and shorting element 53 are formed in unison with the calendar plate 173 by plating or vapor deposition. However, the calendar plate 173 differs from the calendar plate 73 in that the area where the second conductor 52 is disposed is limited to the area around the shorting element 53 as shown in FIG. 4B. In this embodiment, the second conductor 52 contacts the first magnetic shield 46.

The first magnetic shield 46 is a conductor having a nickel coating over a pure iron plate, and functions as the bottom antenna plane of the inverted-F antenna.

As in the first embodiment, by forming the second conductor 52 over the entire back surface of the calendar plate 173, the volume of the inverted-F antenna is reduced by the size of the escape 736 forming a date indicator holder 732, and antenna sensitivity drops. More specifically, compared with a configuration not having the escape 736, sensitivity drops approximately 1.5 dB. To avoid a drop in sensitivity while providing an escape 736, the thickness of the entire calendar plate should be increased, but this also increases the thickness of the electronic timepiece W.

By forming the second conductor 52 only near the shorting element 53 on the back side of the calendar plate 173, and electrically connecting the second conductor 52 to the first magnetic shield 46 in this embodiment, the first magnetic shield 46 is also made to function as the bottom antenna plane. As a result, a drop in antenna sensitivity can be suppressed without increasing the volume between the top antenna plane and the bottom antenna plane when compared with the first embodiment, and without increasing the thickness of the electronic timepiece W.

The nickel coating on the first magnetic shield 46 may be formed by plating similarly to a conventional magnetic shield. The thickness of this nickel coating may be approximately one micrometer as in a conventional magnetic shield, but is preferably greater than or equal to 2 micrometers and less than or equal to 10 micrometers. Because pure iron has high electrical resistance (electrical resistance of iron is $1.0\times10^{-7}$ Ωm, and copper $1.68\times10^{-8}$ Ωm), if the thickness of the plated coating on the first magnetic shield 46 is 1 micrometer, the sensitivity of the inverted-F antenna drops approximately 1.0 dB compared with a thickness of 3 micrometers or more due to the skin effect. As a result, the thickness of the plated coating on the first magnetic shield 46 is preferably 2-10 micrometers, and further preferably greater than or equal to 3 micrometers and less than or equal to 10 micrometers.

The size of the first magnetic shield 46 (area in plan view) is substantially the same as the size of the top antenna plane (the area of the first conductor 51 in plan view), or preferably greater than the size of the top antenna plane. The main function of the first magnetic shield 46 is to assure the magnetic resistance of the movement 11. Depending on the model of the electronic timepiece, a small diameter first magnetic shield 46 may be used, and magnetic resistance may be assured by using multiple magnetic shields. However, if the first magnetic shield 46 is also used as the bottom antenna plane of the inverted-F antenna, the sensitivity of the inverted-F antenna drops if the size of the first magnetic shield 46 is smaller than the size of the top antenna plane. As a result, in a configuration that also uses the first magnetic shield 46 as the bottom antenna plane, the first magnetic shield 46 is preferably a single magnetic shield of a size greater than or equal to the top antenna plane.

Note that when part of the second conductor 52 is superimposed with the first magnetic shield 46 in a plan view, and the remaining part is not superimposed with the first magnetic shield 46, the sum of the area of the first magnetic shield 46 and the area of the other parts (in other words, the area obtained by subtracting the area of the superimposed part from the sum of the area of the second conductor 52 and the area of the first magnetic shield 46) is greater than the area of the first conductor 51 in a plan view.

Figure 5:
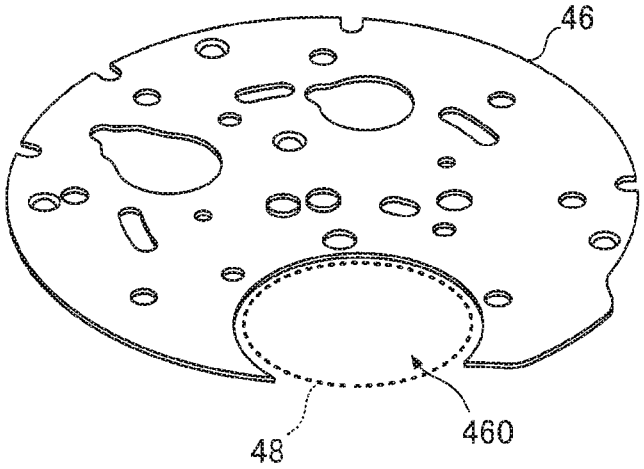
FIG. 5 is an oblique view of the configuration of a magnetic shield with a battery holder.

If the first magnetic shield 46 interferes with the storage battery 48, a battery holder 460 is typically formed in the first magnetic shield 46 as shown in FIG. 5. However, when a battery holder 460 is formed in the first magnetic shield 46, the sensitivity of the inverted-F antenna formed by the calendar plate 173 and first magnetic shield 46 drops approximately 1.0 dB. To use the first magnetic shield 46 as the bottom antenna plane of the inverted-F antenna and avoid a drop in sensitivity, either a thin battery is used for the storage battery 48, or the location of the storage battery 48 is offset toward the back cover side, and a battery holder 460 is not provided in the first magnetic shield 46.

Embodiment 3

Figure 6:
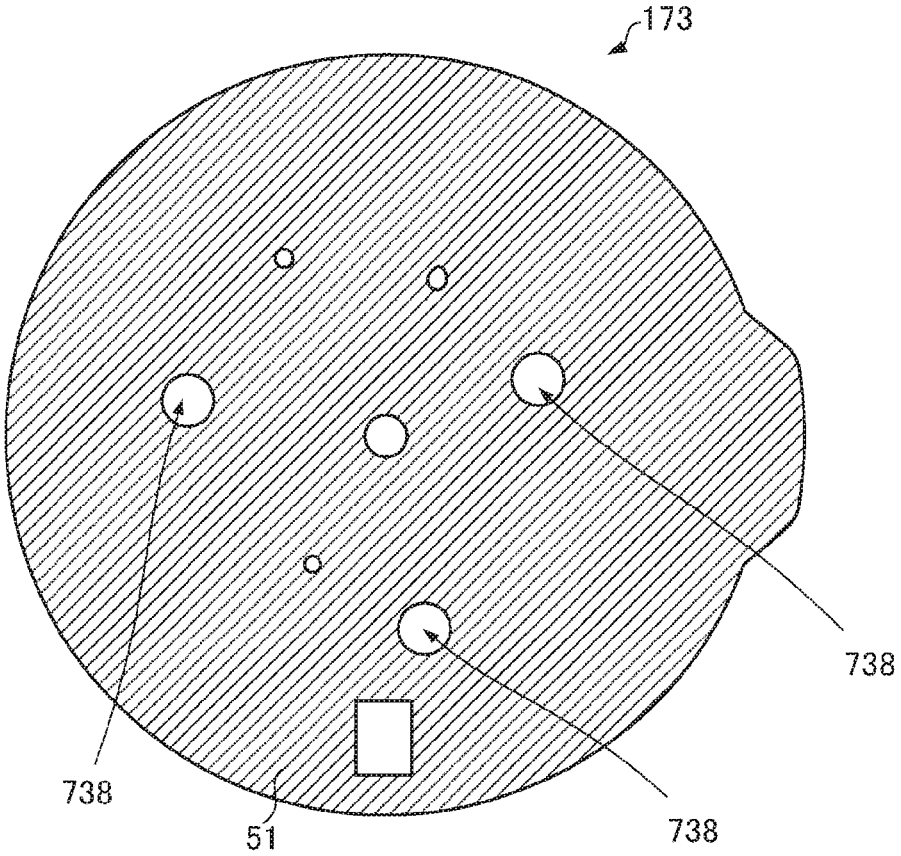
FIG. 6 is a plan view of the configuration of a third embodiment.

An electronic timepiece according to the third embodiment of the invention is described next with reference to FIG. 6. Note that further description of configurations that are the same in this and the foregoing embodiments is omitted below.

When an inverted-F antenna is configured with a first magnetic shield 46 and a calendar plate 173 having a second conductor 52 formed on part of the back side as in the second embodiment, a reliable electrical connection between the second conductor 52 and first magnetic shield 46 is essential. This can be accomplished by forming multiple screw holes in the calendar plate 173, first magnetic shield 46, and movement 11, and fastening the calendar plate 173 to the main plate 60 with screws to hold the movement 11. FIG. 6 is a plan view of a calendar plate 173 having three screw holes 738 for fastening to the main plate 60.

When metal screws (first fasteners having electrical conductivity) are used to fasten the calendar plate 173 to the main plate 60, the first conductor 51 is preferably formed to avoid contact with the screw head and shank so there is no conductivity between the first conductor 51 and first magnetic shield 46 through the screws (or omit forming the first conductor 51 in the part where there is contact with the head and shank of the screws). If there is conductivity between the top antenna plane (first conductor 51) and the first magnetic shield 46 through parts other than the shorting element 53 (for example, through the first fasteners), the resonance frequency of the inverted-F antenna may be affected.

Note that screw holes 738 may be likewise formed in the calendar plate 73 in the first embodiment, and the calendar plate 73 fastened to the main plate 60 with screws. In this case, there is preferably no conductivity between the first conductor 51 and second conductor 52 through the first fasteners.

Embodiment 4

A fourth embodiment of the invention is described below with reference to FIG. 7A, FIG. 7B, FIG. 8A, FIG. 8B, FIG. 8C, FIG. 9A, FIG. 9B, and FIG. 9C. Note that further description of configurations that are the same in this and the first embodiment is omitted below.

Figure 7A:
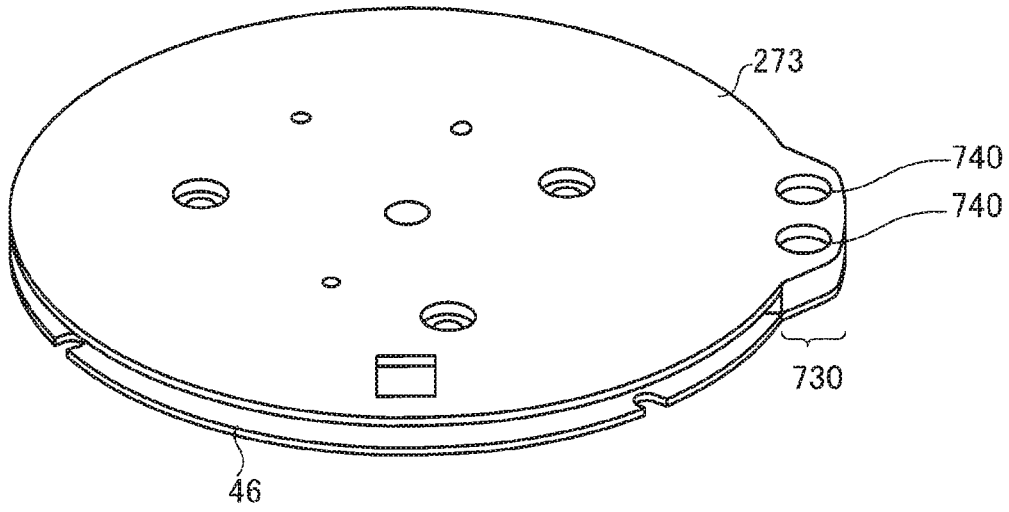
FIG. 7A is an oblique view from the face side of an inverted-F antenna configured using a calendar plate according to a fourth embodiment of the invention.
Figure 7B:
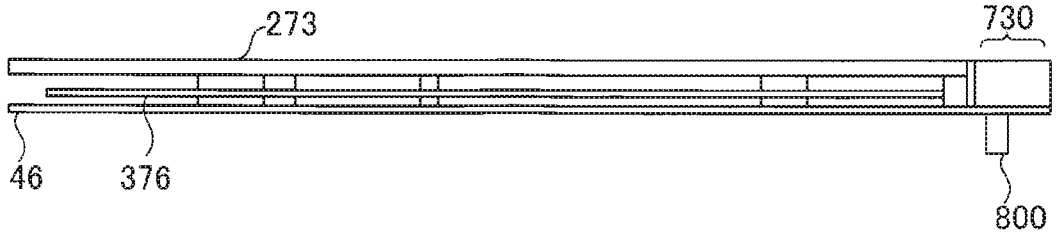
FIG. 7B is a side view of the same inverted-F antenna.

FIG. 7A is an oblique view from the face side of a calendar plate 273 according to a fourth embodiment of the invention. Note that because the configuration on the back side of the calendar plate 273 is the same as the calendar plate 173 according to the second embodiment of the invention, a detailed depiction thereof is omitted. Similarly to the calendar plate 173, calendar plate 273 forms an inverted-F antenna together with the first magnetic shield 46. As shown in FIG. 7B, this calendar plate 273 differs from the calendar plate 173 of the second embodiment in having screw holes 740 that accept screws 800 (second fasteners) for fastening the first magnetic shield 46 in contact with the second conductor 52 disposed in the protruding part 730 of the calendar plate 273.

As with the protruding part 730 disposed to calendar plate 173, a second conductor 52 is formed on the back side of the protruding part 730 of this calendar plate 273. In this embodiment, a structure (screw holes 740) for making contact between the second conductor 52 and the first magnetic shield 46, and fastening the protruding part 730 to the first magnetic shield 46, is disposed to the protruding part 730. As a result, reliable conductivity can be assured between the second conductor 52 and first magnetic shield 46, and the first magnetic shield 46 can reliably function as the bottom antenna plane.

When two screw holes 740 are formed in the protruding part 730, the two screw holes 740 are preferably disposed so that, on a line passing through the centers of the two screw holes 740, the distance D2 on the first conductor 51 from the screw holes 740 to the outside edges of the protruding part 730, and the distance D2 on the first conductor 51 between the two screw holes 740, are preferably equal. The reason is described below.

Figure 8A:
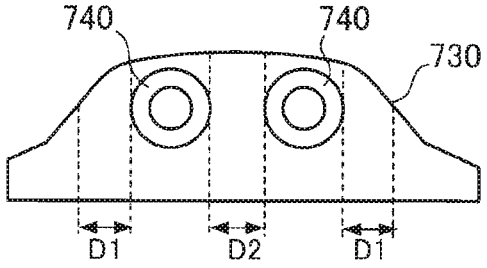
FIG. 8A is a side view of a variation of the inverted-F antenna.
Figure 8B:
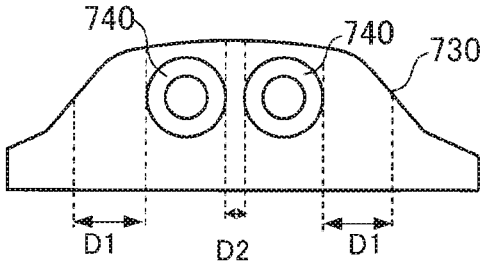
FIG. 8B is a side view of a variation of the inverted-F antenna.
Figure 8C:
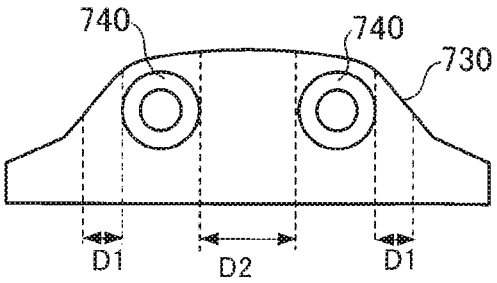
FIG. 8C is a side view of a variation of the inverted-F antenna.

FIG. 8B shows a configuration in which D1>D2, and FIG. 8C shows a configuration in which D1<D2.

Figure 9A:
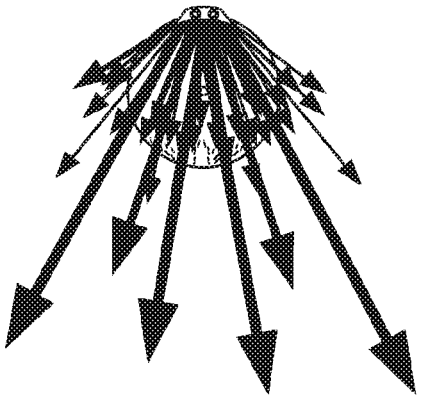
FIG. 9A shows an effect of the invention.

FIG. 9A illustrates the current flow between the two screw holes 740, and the current flow between the screw holes 740 and the outside edges of the protruding part 730, in an inverted-F antenna comprising a calendar plate 273 with screw holes 740 formed in the protruding part 730 as shown in FIG. 8A, and a first magnetic shield 46.

Figure 9B:
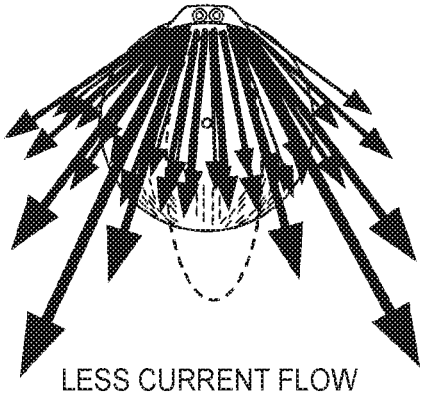
FIG. 9B shows an effect of the invention.

FIG. 9B illustrates the current flow between the two screw holes 740, and the current flow between the screw holes 740 and the outside edges of the protruding part 730, in an inverted-F antenna comprising a calendar plate 273 with screw holes 740 formed in the protruding part 730 as shown in FIG. 8B, and a first magnetic shield 46.

Figure 9C:
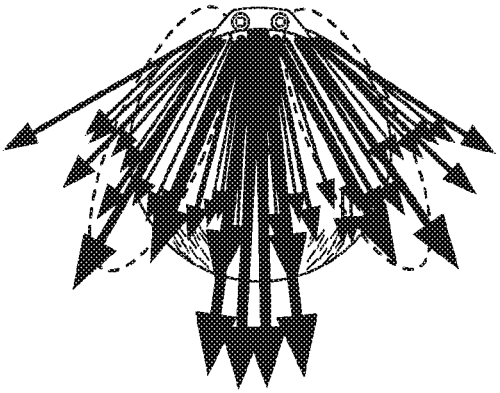
FIG. 9C shows an effect of the invention.

FIG. 9C illustrates the current flow between the two screw holes 740, and the current flow between the screw holes 740 and the outside edges of the protruding part 730, in an inverted-F antenna comprising a calendar plate 273 with screw holes 740 formed in the protruding part 730 as shown in FIG. 8C, and a first magnetic shield 46.

As shown in FIG. 9A, when D1 and D2 are equal, the current flowing between the two screw holes 740, and the current flowing between the screw holes 740 and the outside edges of the protruding part 730, are substantially equal.

However, when D1>D2, the current flowing between the two screw holes 740 decreases as shown in FIG. 9B, and antenna sensitivity drops approximately 0.1 dB compared with the configuration in which D1 and D2 are equal.

However, when D1<D2, the current flowing between the screw holes 740 and the outside edges of the protruding part 730 decreases as shown in FIG. 9C, and antenna sensitivity drops approximately 0.1 dB compared with the configuration in which D1 and D2 are equal.

As a result, a drop in the sensitivity of the inverted-F antenna can be prevented by disposing the screw holes 740 so that D1 and D2 are equal.

Embodiment 5

Figure 10A:
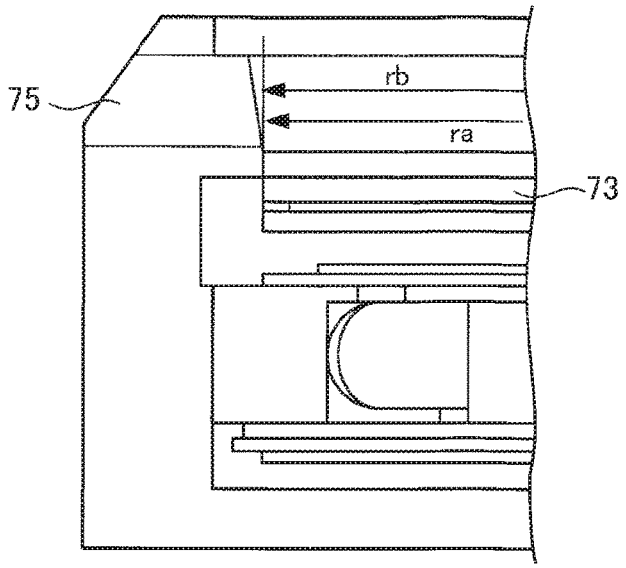
FIG. 10A is a side view of a fifth embodiment of the invention.

An electronic timepiece according to the fifth embodiment of the invention is described next with reference to FIG. 10A, FIG. 10B, and FIG. 10C. Note that further description of configurations that are the same in this and the foregoing embodiments is omitted below.

When the external case 30 is made from a conductive material, the smallest inside diameter of the part disposed above the bottom antenna plane of the inverted-F antenna (referred to below as the minimum inside diameter), that is, the inside diameter of the external case 30, is preferably greater than or equal to the outside diameter of the inverted-F antenna housed in the external case 30. This is because the current flowing to the external case 30 in the opposite direction as the current flowing to the inverted-F antenna increases as the difference between the inside diameter of the external case 30 and the outside diameter of the inverted-F antenna decreases, radio waves reaching the inverted-F antenna are cancelled by the effect of this current, and antenna sensitivity drops.

Figure 10B:
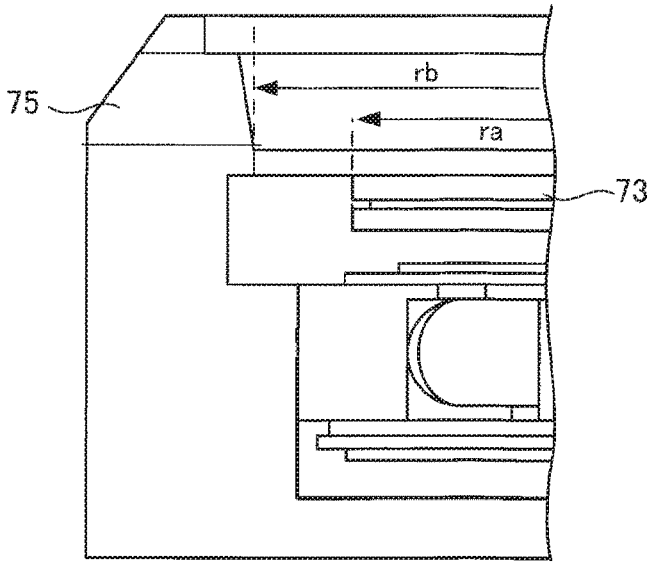
FIG. 10B is a side view of a fifth embodiment of the invention.
Figure 10C:
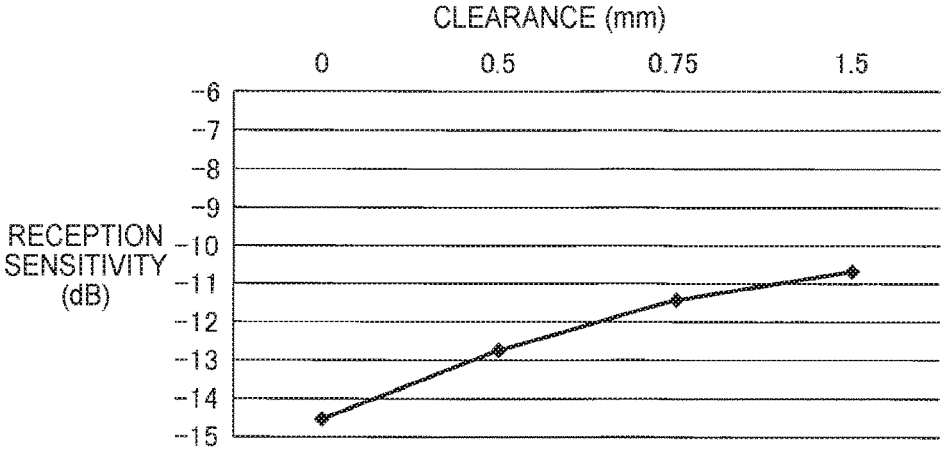
FIG. 10C is a graph of a fifth embodiment of the invention.

In this embodiment, as shown in FIG. 10B, the inside diameter of the bezel 75 is the smallest part of the inside diameter of the external case 30, and the distance between the inside circumference of the bezel 75 and the outside circumference of the inverted-F antenna (referred to below as clearance A) in a plan view is 1.5 millimeter or more.

If a configuration in which the smallest inside diameter rb shown in FIG. 10A is equal to the outside diameter ra of the inverted-F antenna (if clearance A is 0 millimeter) is compared with this embodiment of the invention (clearance A is 1.5 millimeter), the configuration of this embodiment improves antenna sensitivity approximately 4 dB.

Note that this embodiment describes a configuration in which the inside diameter of the bezel 75 is the smallest inside diameter, but if the inside diameter of the case member 32 is the smallest inside diameter, the smallest inside diameter is made to be greater than the outside diameter of the inverted-F antenna.

Embodiment 6

An electronic timepiece according to the sixth embodiment of the invention is described next with reference to FIG. 11. Note that further description of configurations that are the same in this and the foregoing embodiments is omitted below.

Figure 11:
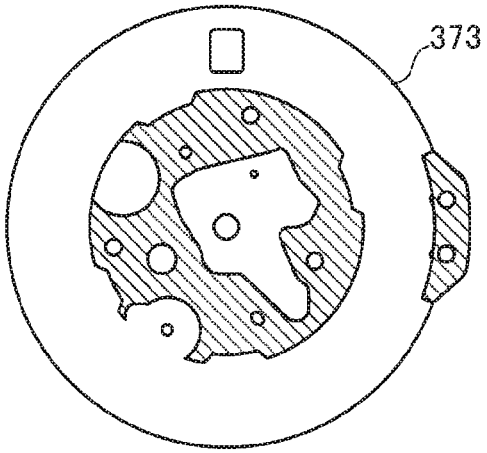
FIG. 11 is a plan view of a calendar plate according to a sixth embodiment of the invention from the back side.

FIG. 11 is a plan view from the back side of the calendar plate 373 according to the sixth embodiment of the invention.

FIG. 11 shows the calendar plate 373 according to the sixth embodiment of the invention from the back. The configuration of the front side of the calendar plate 373 is the same as the calendar plate 173 according to the second embodiment of the invention, and detailed depiction thereof is thus omitted. Similarly to the calendar plate 173, calendar plate 373 forms an inverted-F antenna together with the first magnetic shield 46. In FIG. 11, the second conductor 52 formed on the back surface of the calendar plate 373 is shaded as in FIG. 4B. As will be understood by comparing FIG. 11 and FIG. 4B, the calendar plate 373 according to this embodiment differs from the calendar plate 173 according to the second embodiment of the invention in that the second conductor 52 pattern is formed over the entire area that contacts the first magnetic shield 46 and not only around the shorting element 53. As a result, the area of contact between the first magnetic shield 46 and the second conductor 52 is larger than in the second embodiment, the skin effect described above can therefore be reduced, and antenna sensitivity improves approximately 0.3 dB.

Embodiment 7

An electronic timepiece according to the seventh embodiment of the invention is described next with reference to FIG. 12 and FIG. 13. Note that further description of configurations that are the same in this and the foregoing embodiments is omitted below.

Figure 12:
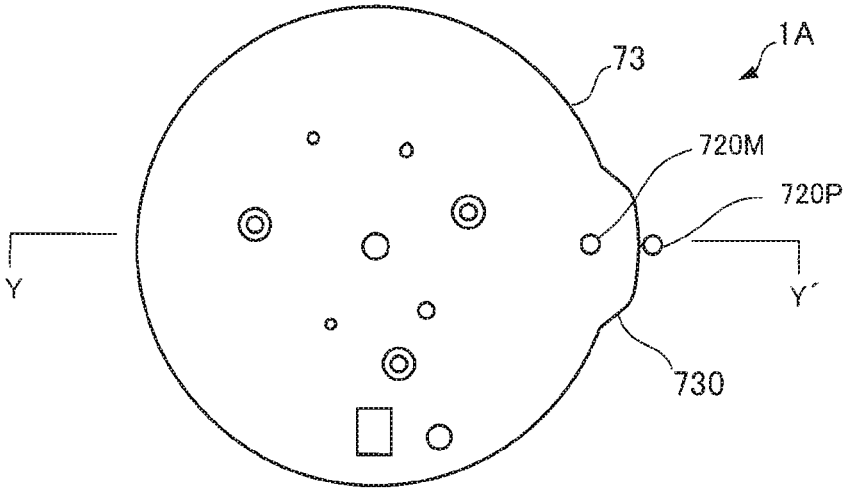
FIG. 12 is a plan view of a calendar plate according to the seventh embodiment of the invention from the face side.
Figure 13:
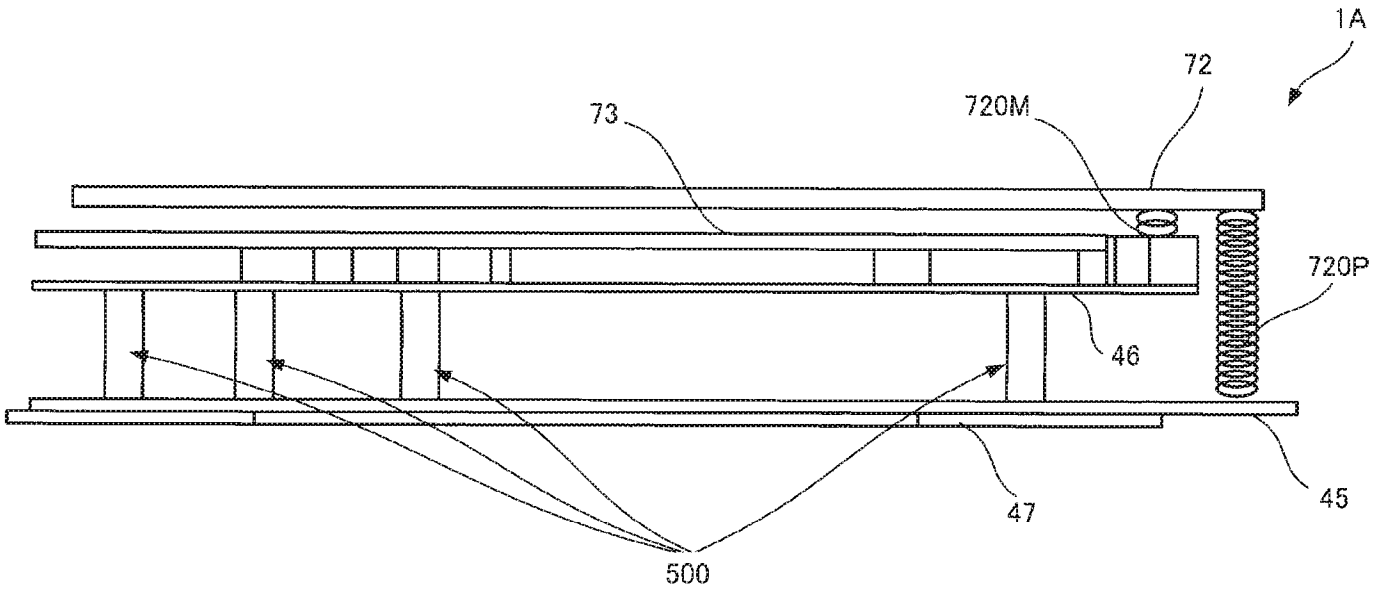
FIG. 13 is a side view of the configuration of another movement including a calendar plate according to the invention.

FIG. 12 is a plan view of the movement 11A of an electronic timepiece according to the seventh embodiment of the invention, and FIG. 13 is a partial section view through line Y-Y' in FIG. 12. Note that the dial 70 is not shown in FIG. 12. The movement 11A according to this embodiment differs from the movement 11 according to the first embodiment of the invention in two ways.

First, the negative terminal of the solar panel 72 (not shown in the figure) is electrically connected through a spring 720M to the first conductor 51 on the face side of the calendar plate 73, which functions as the inverted-F antenna, as shown in FIG. 12 and FIG. 13.

Second, the positive terminal (not shown in the figure) of the solar panel 72 is electrically connected to the circuit board 45 through a spring 720P located outside of the protruding part 730. Also shown in FIG. 13 are metal screws 500 conductively connecting the first magnetic shield 46 and the second magnetic shield 47 for electrostatic prevention.

By providing a spring 720P creating a conductive path between the solar panel 72 and circuit board 45 outside the protruding part 730, a drop in the sensitivity of the inverted-F antenna due to the solar panel 72 can be cancelled. Note that the negative terminal of the solar panel 72 is conductive to the inverted-F antenna because the potential of the inverted-F antenna is the ground potential. If the diameter of the inverted-F antenna is the same as the dial 70, there may not be enough space to dispose both spring 720M and spring 720P outside the protruding part 730. If only the spring 720P is located outside the protruding part 730, the space outside the protruding part 730 can be reduced compared with a configuration having both spring 720M and spring 720P located outside the protruding part 730. As a result, the size of the electronic timepiece can be reduced, and the effect of the solar panel can be cancelled. In this embodiment, the negative terminal of the solar panel 72 is electrically connected to the first conductor 51, but if the ground potential is applied to the positive terminal of the solar panel 72, the positive terminal may be electrically connected to the first conductor 51. In other words, the first conductor 51 is connected to whichever of the positive terminal and negative terminal of the solar panel 72 the ground potential is applied.

Embodiment 8

Figure 14:
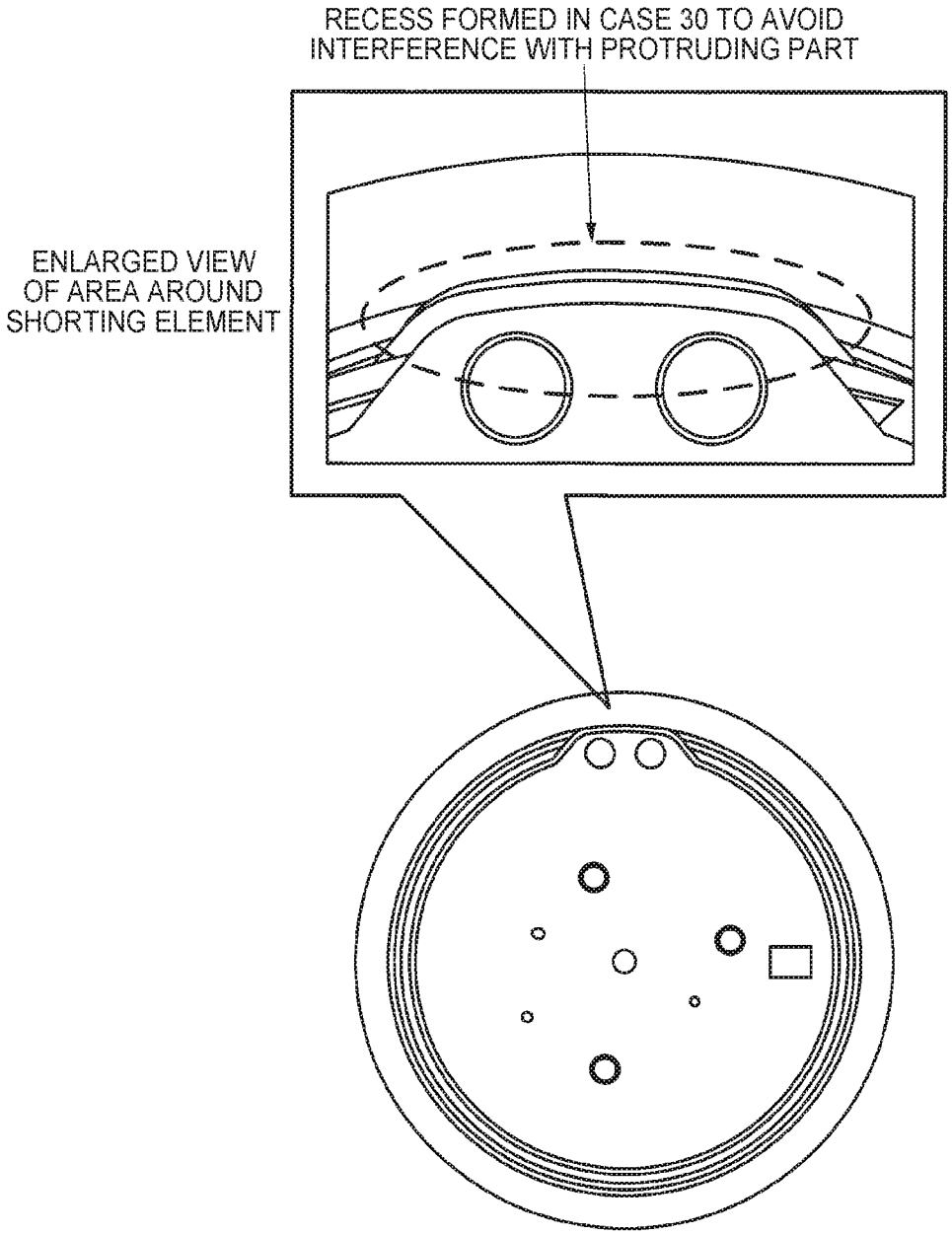
FIG. 14 includes a plan view and an enlarged view of an eighth embodiment of the invention.

An electronic timepiece according to the eighth embodiment of the invention is described next with reference to FIG. 14. Note that further description of configurations that are the same in this and the foregoing embodiments is omitted below.

To provide conductivity between the shorting element 53 and the second conductor 52 while avoiding the date indicator 376 in the embodiments described above, the shorting element 53 protrudes toward the side of the external case 30 (referred to below as toward the case member 32). As a result, the shorting element 53 may conflict with the case member 32 if the diameter of the case member 32 is reduced. This can be resolved by providing an escape around the shorting element 53 of the case member 32 as shown in FIG. 14 (more specifically, providing a recess corresponding to the shape of the shorting element 53 in the part of the case member 32 corresponding to the location of the shorting element 53).

If in this configuration the size of the escape in the case member 32 is small (that is, the gap between shorting element 53 and the side wall of the case member 32 facing the shorting element 53 (referred to below as clearance B) is small), current flowing in the opposite direction as the current flowing to the shorting element 53 flows to the side wall of the case member 32 facing the shorting element 53, and the sensitivity of the inverted-F antenna drops. In tests conducted by the inventors, antenna sensitivity drops approximately 0.5 dB if clearance B is less than 0.5 millimeters. To avoid this drop in antenna sensitivity, clearance B is preferably greater than or equal to 0.5 millimeter.

Embodiment 9

Figure 15:
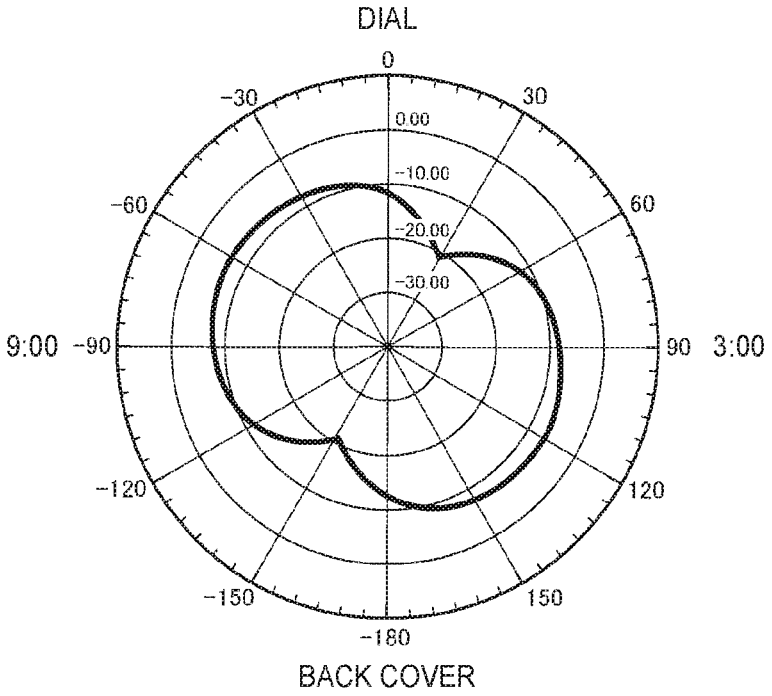
FIG. 15 illustrates the directivity of an inverted-F antenna.

An electronic timepiece according to the ninth embodiment of the invention is described next with reference to FIG. 15. Note that further description of configurations that are the same in this and the foregoing embodiments is omitted below.

The directivity of the right-handed polarized waves of the inverted-F antenna in a side view of the inverted-F antenna from the shorting element 53 side is biased approximately 60 degrees to the right from the perpendicular to the top antenna plane. As a result, the inverted-F antenna is preferably disposed in the external case 30 with the shorting element 53 of the inverted-F antenna in the direction of 12:00 on the electronic timepiece W. By disposing the shorting element 53 in this way, directivity is biased toward 9:00 approximately 60 degrees perpendicularly to the dial. When signals from the GPS satellites 8 are received with the electronic timepiece W worn on the left wrist and the user is walking with the arm hanging naturally down, the 9:00 side of the electronic timepiece W is facing vertically up. As a result, the directivity of the inverted-F antenna and the vertically up orientation of the electronic timepiece W are substantially aligned, and satellite signals can be efficiently received.

Embodiment 10

An electronic timepiece according to the tenth embodiment of the invention is described next with reference to FIG. 16 and FIG. 17. Note that further description of configurations that are the same in this and the foregoing embodiments is omitted below.

Figure 16:
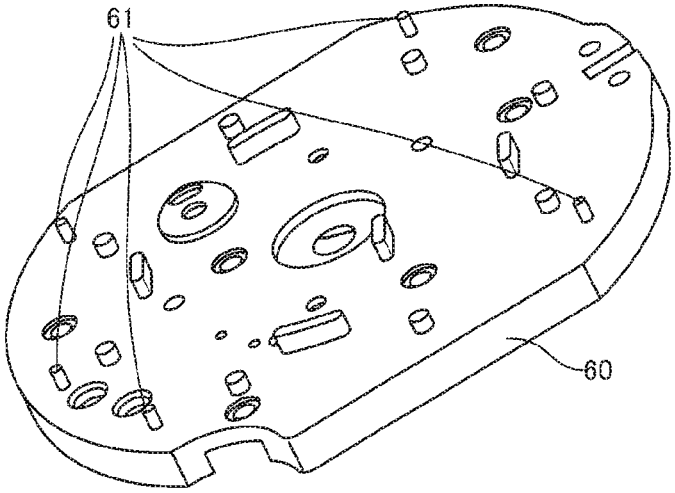
FIG. 16 is a perspective view of the configuration of a main plate according to a tenth embodiment of the invention.
Figure 17:
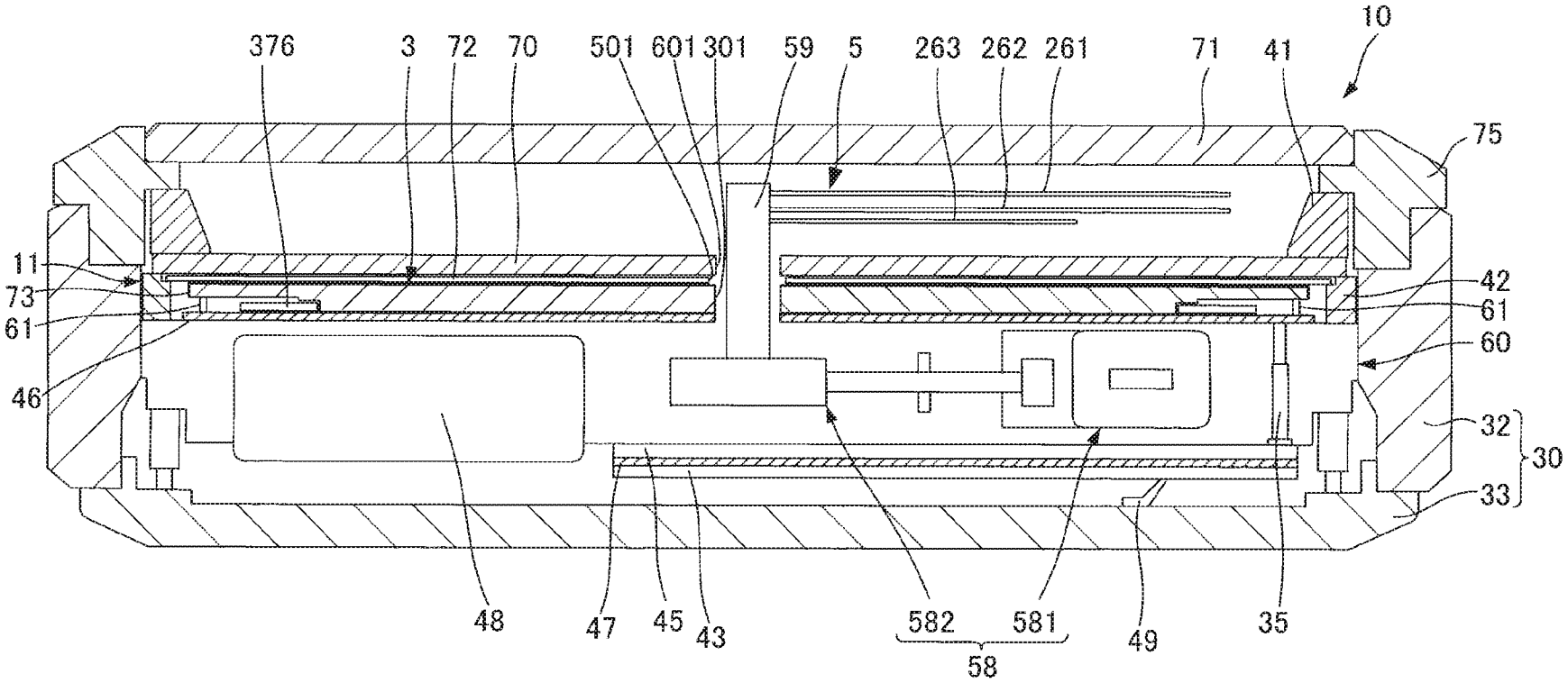
FIG. 17 is a sectional side view of the configuration of a main plate according to a tenth embodiment of the invention.

FIG. 16 and FIG. 17 illustrate the configuration of the main plate 60 in an electronic timepiece W according to the tenth embodiment of the invention. FIG. 16 is an oblique view of the face side of the main plate 60, and FIG. 17 is a section view of the electronic timepiece W.

As shown in FIG. 17, the electronic timepiece W has a calendar plate 73. As described above, an escape 736 is disposed in the calendar plate 73 to form a date indicator holder 732 at the position corresponding to the date indicator 376 (see FIG. 3C). The main plate 60 according to this embodiment differs from the main plate 60 described above in having multiple cylindrical support members 61 for supporting the escape 736. There are multiple support members 61 disposed at positions outside the date indicator. The thickness of the escape 736 part of the calendar plate 73 is extremely thin (such as 0.5 millimeter or less), and if the escape 736 sags, disposing the first conductor 51 that functions as the top antenna plane parallel to the second conductor or first magnetic shield 46 that functions as the bottom antenna plane becomes difficult, and variation results in the antenna sensitivity and resonance frequency.

However, this embodiment of the invention has multiple support members 61 each supporting the escape 736 of the calendar plate 73 from below. As a result, the escape 736 is prevented from sagging, and variation in the antenna sensitivity and resonance frequency of the inverted-F antenna 3 is suppressed.

Variations

Embodiments 1 to 10 are described above, but the invention is not limited thereto and can be varied as described below.

(1) In the second embodiment, the first magnetic shield 46 also functions as the bottom antenna plane, but if there is a conductive plate disposed between the second conductor 52 and the main plate 60, a conductive plate other than a magnetic shield may be used as the bottom antenna plane.

(2) An inverted-F antenna is formed in the foregoing embodiments by providing a shorting element 53 the electrically connects a first conductor 51 functioning as a top antenna plane, and a second conductor or first magnetic shield 46 functioning as a bottom antenna plane, but the first conductor 51 and a second conductor or first magnetic shield 46 may be configured as a patch antenna without using a shorting element 53.

(3) The foregoing embodiments are described using the example of the Global Positioning System using GPS satellites 8 as the positioning information satellites in a Global Navigation Satellite System (GNSS), but this configuration is only one example. The invention can also be used with other Global Navigation Satellite Systems (GNSS), including Galileo (EU), GLONASS (Russia), or Beidou (China), as well as other positioning information satellites that transmit satellite signals, including the SBAS and other geostationary or quasi-zenith satellites.

In other words, the electronic timepiece W may be configured to acquire one or more of the calendar information, time information, location information, and speed information that can be acquired by receiving and processing radio waves (wireless signals) transmitted from positioning information satellites including GPS satellites 8 or other satellites. Note that a regional navigation satellite system (RNSS: Regional Navigation Satellite System) may also be used instead of or in addition to a Global Navigation Satellite System (GNSS). In this case, the antenna structure can be adapted appropriately to the specific regional navigation satellite system.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2018-050959 filed Mar. 19, 2018 is expressly incorporated herein by reference.

What is claimed is:

1. An electronic timepiece comprising:

a dial; and a calendar plate holding a calendar wheel disposed on a back side of the dial, the calendar plate having:

a first surface facing the back side of the dial; and a second surface facing oppositely away from the first surface, wherein a first conductor of an antenna is disposed on the first surface and a second conductor of the antenna is disposed on the second surface at a position superimposed with the first conductor in a plan view.

2. The electronic timepiece described in claim 1, wherein:

the calendar plate has a side surface located between the first surface and the second surface, and a shorting conductor disposed on the side surface and electrically connecting the first conductor to the second conductor.

3. The electronic timepiece described in claim 1, further comprising:

a main plate disposed on the second surface side of the calendar plate; and a first fastener disposed non-conductively to the first conductor and second conductor, and fastening the calendar plate to the main plate.

4. The electronic timepiece described in claim 1, further comprising:

a solar panel disposed between the dial and the calendar plate.

5. The electronic timepiece described in claim 4, wherein:

the first conductor is connected to one of a positive terminal and a negative terminal of the solar panel, the one of the positive and negative terminal having a ground potential applied thereto.

6. The electronic timepiece described in claim 1, further comprising:

a conductive case housing the calendar plate, an inside diameter of the case being greater than an outside diameter of the calendar plate in the plan view.

7. An electronic timepiece comprising:

a dial;

a calendar plate holding a calendar wheel disposed on a back side of the dial, the calendar plate having:

a first surface facing the back side of the dial; and a second surface facing oppositely away from the first surface, wherein a first conductor of an antenna is disposed on the first surface and a second conductor of the antenna is disposed on the second surface at a position superimposed with the first conductor in a plan view;

a main plate disposed on the second surface side of the calendar plate; and a conductor plate disposed between the calendar plate and the main plate, and electrically connected as an element of the antenna to the second conductor.

8. The electronic timepiece described in claim 7, wherein:

the calendar plate has a side surface located between the first surface and the second surface, and a shorting conductor disposed on the side surface and electrically connecting the first conductor and second conductor.

9. The electronic timepiece described in claim 7, wherein:

the conductor plate is a magnetic shield.

10. The electronic timepiece described in claim 9, wherein:

the magnetic shield is a pure iron plate with a nickel coating, and a thickness of the nickel coating is greater than or equal to 2 micrometers and less than or equal to 10 micrometers.

11. The electronic timepiece described in claim 7, wherein:

an area obtained by subtracting an area where the second conductor is superimposed with the conductor plate from a sum of an area of the second conductor and an area of the conductor plate is greater than the area of the first conductor in the plan view.

12. The electronic timepiece described in claim 7, further comprising:

a second fastener disposed superimposed in the plan view with the second conductor and the conductor plate, and fastening the second conductor element in contact with the conductor plate.

13. The electronic timepiece described in claim 1, wherein:

in the plan view, an outside diameter of the first conductor is greater than an inside diameter of the calendar wheel.

14. The electronic timepiece described in claim 1, wherein:

the calendar plate covers the calendar wheel, and has an opening through which part of the calendar wheel is visible.

15. An electronic timepiece comprising:

a dial;

a disk shaped calendar plate disposed on a back side of the dial, the calendar plate having:

a first surface facing the back side of the dial;

a second surface facing oppositely away from the first surface; and a side surface extending from the first surface to the second surface; and an antenna integrated with the calendar plate, the antenna including:

a planar radiating electrode laminated onto the first surface and diametrically extending beyond a periphery of the calendar plate;

a planar ground electrode laminated onto the second surface and diametrically extending beyond the periphery of the calendar plate, the ground electrode being superimposed with the planar radiating electrode in a plan view; and a shorting conductor laminated onto the side surface and electrically connecting the radiating electrode to the ground electrode.

16. The electronic timepiece described in claim 15, further comprising:

a main plate disposed on the second surface side of the calendar plate; and a fastener disposed non-conductively to the radiating electrode and ground electrode, and fastening the calendar plate to the main plate.

17. The electronic timepiece described in claim 15, further comprising:

a main plate disposed on the second surface side of the calendar plate; and a conductor plate disposed between the calendar plate and the main plate, and electrically connected as an element of the antenna to the ground electrode.

18. The electronic timepiece described in claim 17, wherein:

the conductor plate is a magnetic shield.

19. The electronic timepiece described in claim 15, further comprising:

a solar panel disposed between the dial and the calendar plate.

20. The electronic timepiece described in claim 15, further comprising:

a conductive case housing the calendar plate, an inside diameter of the case being greater than an outside diameter of the calendar plate in the plan view.

* * * * *